United States Patent [19]

Pogonowski

[11] 4,123,913

[45] Nov. 7, 1978

[54] MECHANISMS FOR INTERCONNECTING TWO CYLINDERS UNDERGROUND

[75] Inventor: Ivo C. Pogonowski, Blacksburg, Va.

[73] Assignee: Texaco Inc., New York, N.Y.

[21] Appl. No.: 763,392

[22] Filed: Jan. 28, 1977

Related U.S. Application Data

[62] Division of Ser. No. 644,367, Dec. 24, 1975, Pat. No. 4,064,703.

[51] Int. Cl.[2] ..... E02D 5/44

[52] U.S. Cl. ..... 405/244; 29/523; 227/9; 405/303

[58] Field of Search ..... 61/53, 53.68, 53.5, 61/63, 94, 98; 227/9, 10; 29/523, 526, 432; 52/726, 288, 298

[56] References Cited

U.S. PATENT DOCUMENTS

| | | | |
|---|---|---|---|
| 277,427 | 5/1883 | Recht | 29/523 |
| 2,470,117 | 5/1949 | Temple | 227/9 X |
| 3,453,831 | 7/1969 | Rusche | 61/53.7 X |
| 3,471,174 | 10/1969 | Manning | 227/9 X |
| 3,555,831 | 1/1971 | Pogonowski | 61/94 |
| 3,637,127 | 1/1972 | Maier et al. | 227/9 |
| 3,981,064 | 9/1976 | Hafner | 29/432 |

*Primary Examiner*—Jacob Shapiro

*Attorney, Agent, or Firm*—Carl G. Ries; Thomas H. Whaley; Theron H. Nichols

[57] ABSTRACT

Mechanisms for joining two telescopic cylinders underwater in a temporary and inexpensive manner are disclosed, particularly when used in anchoring piles or in offshore tower legs. A gun fires projectiles radially from internally of the pile formed of telescopic cylinders to form the plurality of outwardly extending anchoring bumps in the walls of the cylinders. The projectiles are fired in a horizontal plane radially outwardly and from within and normal to the two telescopic cylinders underwater, for example, with two bumps being formed by each projectile, which bumps overlie each other tightly prior to their being penetrated by the projectile which holds the two bumps together. A number of radiating guns form a like number of pairs of bumps in a circle around the periphery of the telescopic cylinders to form an efficient, inexpensive, and simple temporary connection holding the two cylinders together. After forming the bumps in the buried pile cylinders and simultaneously packing the soil around them, each projectile penetrates its bump and packed soil to provide a pile or offshore tower legs with high resistance to separation of the telescoped cylinders forming the pile or offshore tower legs, with increased load-carrying-capacity and with increased resistance-to-pull-out.

10 Claims, 6 Drawing Figures

MECHANISMS FOR INTERCONNECTING TWO CYLINDERS UNDERGROUND

This is a division of application Ser. No. 644,367, filed Dec. 24, 1975, now U.S. Pat. No. 4,064,703, issued Dec. 27, 1977.

BACKGROUND OF THE INVENTION

An age old problem has been to increase the lead carrying capacity of a pile and to increase its resistance against pullout in sandy or other granular soil, for example. Another problem has been the temporary joining of two tubes or cylinders, as when erecting an offshore tower with telescopic leg joints underwater to be held in place until permanently joined or fixed in position. Another problem is to temporarily join two cylinders without expensive and costly prior preparation.

The disclosed invention is an improvement over my prior methods and mechanisms for connecting two telescopic tubes together underwater illustrated in my U.S. Pat. No. 3,555,831, of Jan. 19, 1971, or U.S. Pat. No. 3,834,012 of Sept. b 10, 1974. Other examples of increasing pile pullout resistance as by forming corrugations or bumps are disclosed in U.S. Pat. Nos. 3,453,831(7-69); 3,375,670 (4-68); and British Pat. No. 1,034,128 of 1964, over which the disclosed invention is a substantial improvement.

OBJECTS OF THE INVENTION

Accordingly, a primary object of this invention is to provide a method for anchoring a pile in sandy soil, particularly underwater.

Another primary object of this invention is to provide a method for interconnecting two telescopic cylinders, particularly underwater.

A further object of this invention is to provide a mechanism for formina high load-carrying-capacity and a high resistant-to-pullout pile formed with two telescopic cylinders.

A still further object of this invention is to provide a mechanism for interconnecting two telescopic cylinders underwater in an efficient, quick, and economical manner.

A further object of this invention is to provide a mechanism for anchoring a pile that is easy to operate, is of simple configuration, is economical to build and assemble, and is of greater efficiency for providing increased load-carrying-capacity and of increased resistance-against-pullout in a sandy or other granular soil.

Other objects and various advantages of the disclosed pile-setting device and telescopic tube interconnecting mechanism will be apparent from the following detailed description, together with accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, a few forms or mechanisms for carrying out the method of the invention wherein like reference numerals have been employed to indicate similar parts in the several views in which.

DESCRIPTION OF THE INVENTION

The invention disclosed herein, the scope of which being defined in the appended claims, is not limited in its application to the details of construction and arrangement of parts shown and described for carrying out the disclosed methods, since the invention is capable of other embodiments for carrying other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

A HIGH LOAD CARRYING CAPACITY AND HIGHLY RESISTANT-TO-PULLOUT PILE

Figure 1:
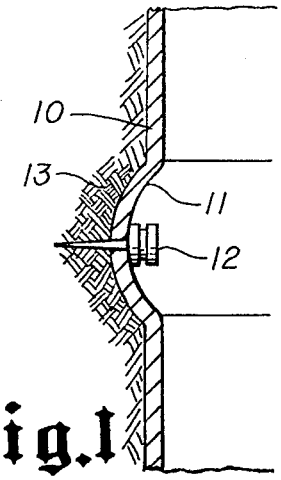
FIG. 1 is a schematic longitudinal sectional elevation of the portion of the pile in the ground having the new soil-holding feature.

FIG. 1 discloses a longitudinal sectional elevation of a portion of one modification of the pile 10 that is driven in the ground having the new soil-holding feature on it. This portion of the pile has a bump 11 formed in one side of it with a headed spike 12 driven into the middle of the bump and into the resultant packed soil 13 therearound. It may be noted that as the headed spike is driven into the pile wall from the inside, it first bulges out the side wall, making the hemispherical bump and packing the soil in that immediate area, then with added pressure and force the headed spike is driven through the center of the bump to protrude it completely outwardly into the dirt that has been packed around the bump. The packing of the dirt around the bump occurred with forming of the bump to compress the dirt that was around the vertical wall prior to the material of the bump being moved outwardly and compressing the dirt thereagainst.

Figure 2:
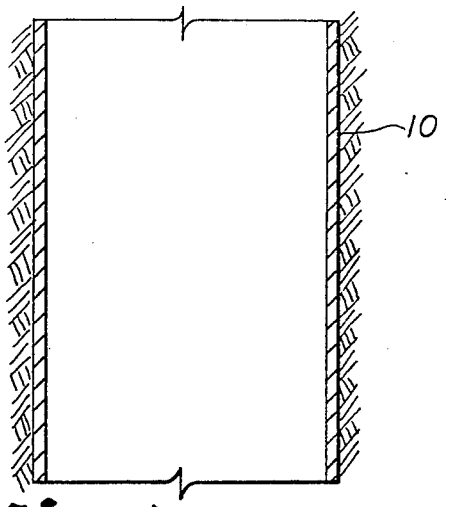
FIG. 2 is a schematic longitudinal sectional elevation of the pile of FIG. 1 prior to bulging and penetrating of the pile with headed spikes.

FIG. 2 is a schematic longitudinal sectional elevation of the pile 10 of FIG. 1 prior to bulging or penetrating of the pile with the headed spikes. Here a portion of the pile is shown driven into the dirt or ocean bottom after the dirt has been removed internally thereof, if necessary.

Figure 3:
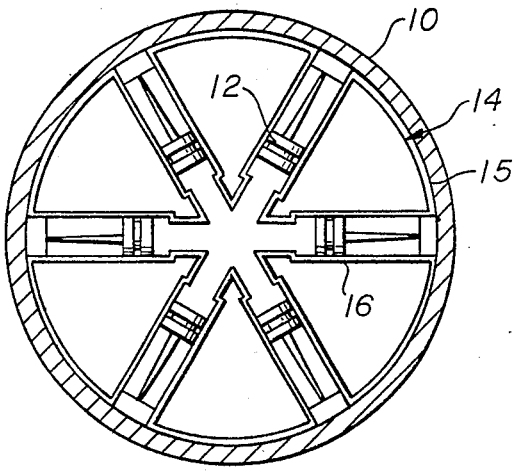
FIG. 3 is a schematic horizontal sectional view of the gun for forming the bumps in the pile walls and for driving the headed spikes into the pile wall.

FIG. 3 is a schematic view or horizontal sectional view of the gun for driving the headed spikes 12 into the side walls of the pile 10. The gun 14 is positioned or lowered down into a pile to the depth of the sand strata where the bumps are desired to be formed. Here a cylindrical housing 15 that holds a multiplicity of barrels 16, all barrels being in a horizontal plane and firing radially outwardly. Gun housing 15 includes a high pressure fluid introduced behind the headed spikes 12 as controlled from the surface similar to the hydraulic guns disclosed in my above identified U.S. Pat. No. 3,555,831, but with the spike heads acting as the piston.

If more than one horizontal row of bumps is required, a multiple row gun may be used similar to that in my U.S. Pat. No. 3,834,012. With the gun housing positioned internally of the pile and ready for firing, the headed spikes may be fired in either of two ways. First, each barrel 16 or gun may be fired in consecutive order around the outer periphery of the gun to drive its respective headed spike 12 into the pile wall 10, or the second method may comprise the simultaneous firing of all guns at one time for driving all spikes simultaneously out through the pile into the packed ground therearound each bump, depending on the particular desired hydraulic ducting and controls from the surface to the guns.

Figure 4:
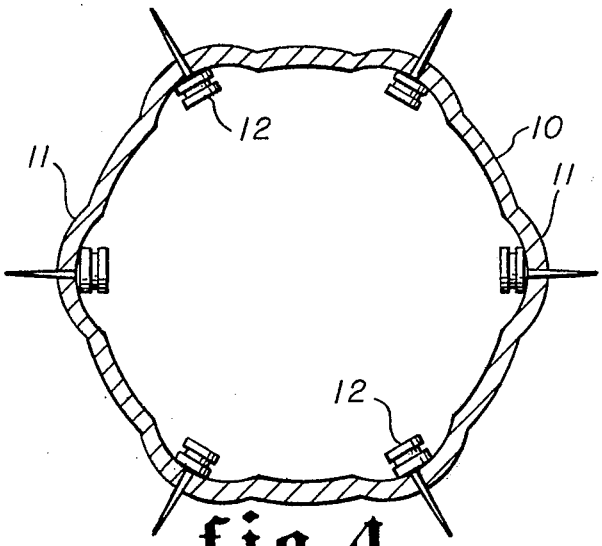
FIG. 4 is a schematic horizontal sectional view of the new pile after forming of the bulges and driving of the spikes through the walls of the cylinders by the gun of FIG. 3.

FIG. 4 is a horizontal sectional view after the gun 14 of FIG. 3 has been fired for forming the bulges and for packing the soil and for driving the spikes through the walls of the cylinder, the gun having been removed. Increased pull-out resistance results from both the bumps 11 and the headed spikes 17 protruding into the packed soil. Thus a pile having increasing load-carrying-capacity and increased resistance-to-pull-out is disclosed.

A MECHANISM FOR INTERCONNECTING TWO TELESCOPIC CYLINDERS UNDERWATER

Figure 5:
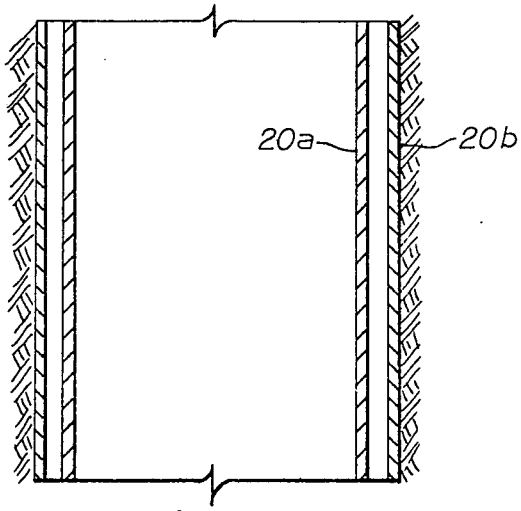
FIG. 5 is a schematic longitudinal sectional elevation of a portion of two telescopic cylinders prior to being fastened together.

FIG. 5 is a schematic longitudinal sectional elevation or view of the portion of the two telescopic cylinders 20*a*, 20*b*, prior to being fastened together forming a second modification. This is a section buried underground in the area to be secured together.

Figure 6:
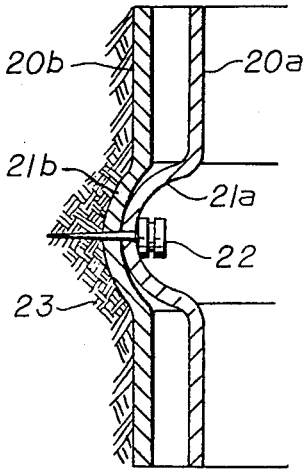
FIG. 6 is a longitudinal sectional elevation of a portion of two telescopic cylinders of FIG. 4 joined together.

FIG. 6 is a longitudinal sectional elevation of a portion of the two telescopic cylinders 20*a*, 20*b* joined together by a multiple barrel gun similar to gun 14. Here the two bumps 21*a* and 21*b* are shown after having been formed by the outward actuation or movement of a headed pin 22 which pin after having pushed or formed the bumps 21*a*, 21*b*, in the two surfaces of the two cylinders 20*a*, 20*b*, has now penetrated both walls into the packed soil 23, which soil was packed by the forming of the bump 21.

In operation of the embodiment of FIGS. 5 and 6, or for connecting the two telescopic cylinders together, at least temporarily, the guns, in this embodiment likewise, are made so that they may be fired in consecutive order around the periphery or they all may be fired simultaneously, if so desired. The guns are formed powerful enough to fire the headed spike out to engage the walls of the two bumps 21*a*, 21*b* of the two cylinders 20*a*, 20*b*. Upon first movement of the spike 22, the bulges 21*a*, 21*b* are formed thereby for packing the soil until finally with increased force or with continued force of outward movement, the spike penetrates both walls to extend therethrough. The spikes thus form at least a temporary junction or connection connecting the two walls together and form additional means for increasing the pull-out resistance of the outer cylinder from the soil therearound.

Accordingly an efficient, inexpensive, and simple connection for holding two telescopic cylinders, as piles or offshore tower legs, together.

Accordingly, it will be seen that the disclosed new mechanisms for interconnecting two telescopic cylinders for forming a pile or offshore tower leg will operate in a manner which meets each of the objects set forth hereinbefore.

While only one mechanisms has been disclosed, it will be evident that various other modifications are possible in the arrangement and construction of the disclosed mechanism for interconnecting two telescopic cylinders for forming a pile or an offshore tower leg without departing from the scope of the invention and it is accordingly desired to comprehend within the purview of this invention such modifications as may be considered to fall within the scope of the appended claims.

I claim:

1. A mechanism for interconnecting two cylinders having telescoped cylindrical walls buried in a sandy soil strata and other granular soils comprising, (a) a plurality of headed spike means for being driven radially outwardly for forming a plurality of outwardly extending bumps in a horizontal plane around the periphery of the telescoped cylindrical walls, (b) said outwardly extending bumps being means for packing the sandy soil strata around said bump means, and (c) each spike means penetrating each bump means as said spike means is pressed outwardly further after forming said bump means to lodge in said packed sandy soil strata with only said spike heads remaining in the telescopic cylinders for increasing the resistance to separation of the two interconnected telescopic cylinders, for increasing the load-carrying capacity of the interconnected cylinders when forming a portion of a pile, and for increasing the resistance to pullout of the interconnected telescopic cylinders in the sandy soil strata and other granular soils when used as a portion of a pile.

2. A mechanism for interconnecting two cylinders having telescoped cylindrical walls buried in a sandy soil strata and other granular soils comprising, (a) a plurality of headed spike means for being fired radially outwardly in the horizontal plane for pressing outwardly a plurality of outwardly extending bumps in a horizontal plane around the periphery of the telescoped cylindrical walls in the sandy soil strata (b) said outward extending bumps being means for packing the soil around the bumps, (c) said headed spike means penetrating the bumps after forming of the bumps by continued outward movement of the headed spike means until only the spike heads remain in the telescoped cylindrical walls, and (d) said spike means penetrating the packed soil around the bumps for increasing the load-carrying capacity and for increasing the resistance to pullout and separation of the two interconnected cylinders in the sandy soil strata and other granular soils.

3. A mechanism for interconnecting two cylinders having telescoped cylindrical walls buried in a sandy soil strata and other granular soils comprising, (a) gun means for driving a plurality of headed spike means from within the inner telescopic cylinder radially outwardly into the telescopic cylindrical walls, (b) said headed spike means forming a plurality of outwardly extending bumps in the outer periphery of the telescopic cylindrical walls by outward movement of the headed spike means, (c) said bumps comprising means for packing the soil around said bump means in the walls of the telescopic cylinders, and (d) said headed spike means penetrating said bump means radially outwardly of the telescopic cylinders and penetrating the packed soil until said spike heads remain in the telescoped cylindrical walls for increasing the load-carrying capacity and the resistance to pullout, and for increasing the resistance to separation of the telescopic cylinders in the sandy and other granular soils.

4. A mechanism for interconnecting two telescopic cylinders underwater in the subsoil comprising, (a) gun means internally of the inner telescopic cylinder at the desired depth in the subsoil for firing a plurality of headed spike means radially outwardly in a horizontal plane, (b) said headed spike means forming pairs of outwardly extending bumps in the two telescoped cylindrical walls extending into the subsoil with each bump of the inner wall lying in juxtaposition with the corresponding bump in the outer wall, (c) each of said headed spike means penetrating a pair of bumps and forcing said bumps into the subsoil outside until only said spike heads remain in the inner cylinder, and (d) said spikes squeezing and holding together said two corresponding juxtapositioned bumps of each pair underwater in the subsoil.

5. A mechanism for interconnecting two telescopic cylinders underground comprising, (a) a plurality of spike guns positioned in the inner telescoped cylinder at the desired depth radiating outwardly, (b) headed spike means fired by said spike guns radially outwardly into the two telescopic cylinders for forming a plurality of outwardly extending bump means in the two telescopic cylinders, (c) said bump means of each pair lying contiguous with each other, (d) said headed spike means penetrating each pair of bump means after having formed said bump means, and (e) said headed spike means squeezing each pair of bump means together into a high resistance-to-separation joint underground.

6. A mechanism for interconnecting two telescopic cylinders having cylindrical walls for forming a high load capacity pile for being anchored in sandy soil strata and other granular soils comprising, (a) projected headed spike means for forming bump means extending outwardly on the peripheral surface of the two telescoped cylindrical walls in a horizontal plane after the pile is driven in the ground for providing compressed soil around the bumps, and (b) gun means for projecting said headed spike means extending radially outwardly from the center of each bump into the packed soil therearound each bump for providing a pile having increased resistance to separation of the telescopic cylinders, having increased load-carrying-capacity, and having increased resistance-to-pullout in sandy and other granular soils.

7. A mechanism for interconnecting two telescopic cylinders having cylindrical walls for forming a high load capacity pile comprising, (a) pairs of bumps in the telescoped cylindrical walls of the pile, each pair of bumps being formed in a circular row in the peripheral surface of the telescoped cylindrical walls of the pile in a horizontal plane after the pile is driven into the ground for providing compact soil around each bump, and (b) a plurality of headed spikes protruding from each pair of bumps in the pile, each headed spike extending radially outwardly from the center of each pair of bumps into the packed soil therearound the bumps for providing a pile having increased resistance to separation of the telescopic cylinders, having increased load-carrying-capacity, and having an increased resistance-to-pullout in sandy and other granular soils.

8. A mechanism for interconnecting two telescopic cylinders having cylindrical walls for forming an offshore tower supporting leg buried in a sandy soil strata under the ocean bottom comprising, (a) pairs of contiguous bulges formed extending outwardly on the peripheral surface of the telescopic cylindrical walls of the leg portion at the layer of the sandy soil strata, (b) said contiguous bulges being formed in a line on the peripheral surface of said telescopic cylindrical walls of the leg in a horizontal plane, (c) said contiguous bulges having packed soil therearound the outer bulge of each pair of bulges , and (d) headed spikes extending radially outwardly through the center of each of said pair of bulges into the packed soil around each pair of said bulges for providing an offshore tower supporting leg having increased resistance to separation of the telescopic cylinders, having increased load-carrying-capacity, and having increased resistance-to-pullout in sandy and other granular soils.

9. A mechanism for interconnecting two telescopic cylinders having cylindrical walls for forming an offshore tower supporting leg buried in a sandy soil strata below the ocean bottom comprising, (a) a plurality of pairs of contiguous bumps on the telescopic cylindrical walls of the leg, each pair of bumps being formed in a circular row extending outwardly in the peripheral surface of the telescopic cylindrical walls of the leg in a horizontal plane, (b) each outer bump of each of said pairs of contiguous bumps having compact soil closely packed up against it, and (c) a plurality of headed spike means protruding radially outwardly from the middle of each pair of bumps in the telescopic cylindrical walls of the leg into the packed soil therearound each outer bump for providing a pile having increased load-carrying-capacity, having increased resistance to separation of the telescopic cylinders, and having increased resistance-to-pullout in sandy and other granular soils.

10. A mechanism for interconnecting two telescopic cylinders underground wherein at least a portion of the cylindrical wall of an inner cylinder is telescopically positioned in and contiguous with a portion of the cylindrical wall of an outer cylinder comprising, (a) a cylindrical shaped gun housing having a diameter slightly less than the inner cylinder internal diameter, (b) gun means radiating outwardly in the cylindrical gun housing for firing headed spike means into the telescoped cylindrical walls after the gun housing is lowered to the desired depth in the telescopic cylinders underground, (c) each of said gun means being means for firing a headed spike means into both contiguous walls, said headed spike means being means for forming a pair of overlying outwardly extending contiguous bumps, (d) each of said gun means being means for penetrating the walls of both overlying contiguous bumps with said headed spike means, and (e) said bump means extending out into the ground for packing the ground around said bump means for increasing the resistance to pullout of the interconnected telescopic cylinders.

* * * * *